United States Patent [19]

Kotaro

[11] 3,964,655

[45] June 22, 1976

[54] APPARATUS FOR CONTINUOUS PUSHING OUT OF SHEET PRODUCT FROM BLANK

[75] Inventor: Matumoto Kotaro, Osaka, Japan

[73] Assignee: Dai Nippon Insatsu Kabushiki Kaisha, Tokyo, Japan

[22] Filed: Sept. 25, 1975

[21] Appl. No.: 616,562

[52] U.S. Cl. ..... 225/97; 93/59 ES; 225/105

[51] Int. Cl.[2] ..... B26F 3/02

[58] Field of Search ..... 225/2, 94, 96.5, 97, 225/103, 104, 105; 83/102, 103, 155, 155.1, 157, 161; 198/162, 178; 93/36 A, 59 ES

[56] References Cited

UNITED STATES PATENTS

| | | | |
|---|---|---|---|
| 2,538,425 | 1/1951 | Nolan | 83/155 X |
| 2,881,836 | 4/1959 | Thiem et al. | 93/36 A |
| 3,055,567 | 9/1962 | Sayford | 225/2 |
| 3,391,589 | 7/1968 | Bishop | 83/103 |
| 3,784,070 | 1/1974 | Vossen | 225/97 X |

*Primary Examiner*—Othell M. Simpson
*Assistant Examiner*—Fred A. Silverberg
*Attorney, Agent, or Firm*—Spensley, Horn & Lubitz

[57] ABSTRACT

A pair of endless moving link chains have respective spans which are disposed in opposed relationship and driven in the same direction. One of the pair of the link chains carries thereon outwardly projecting blank holding pins at intervals along the length of the chain, while the other link chain carries thereon outwardly projecting sheet product pushing out pins. The spans of the link chains are disposed in converging relationship with respect to the moving direction of the spans. A blank comprising at least one sheet having cut lines defining a sheet product is supplied into the space between the spans at the upstream end of the space with respect to the moving direction. As the blank is conveyed between the spans the sheet product pushing out pins move transversely relative to and toward the blank holding pins because of the convergence of the spans and finally push out the sheet product from the remaining part of the blank which is being held by the blank holding pins.

10 Claims, 6 Drawing Figures

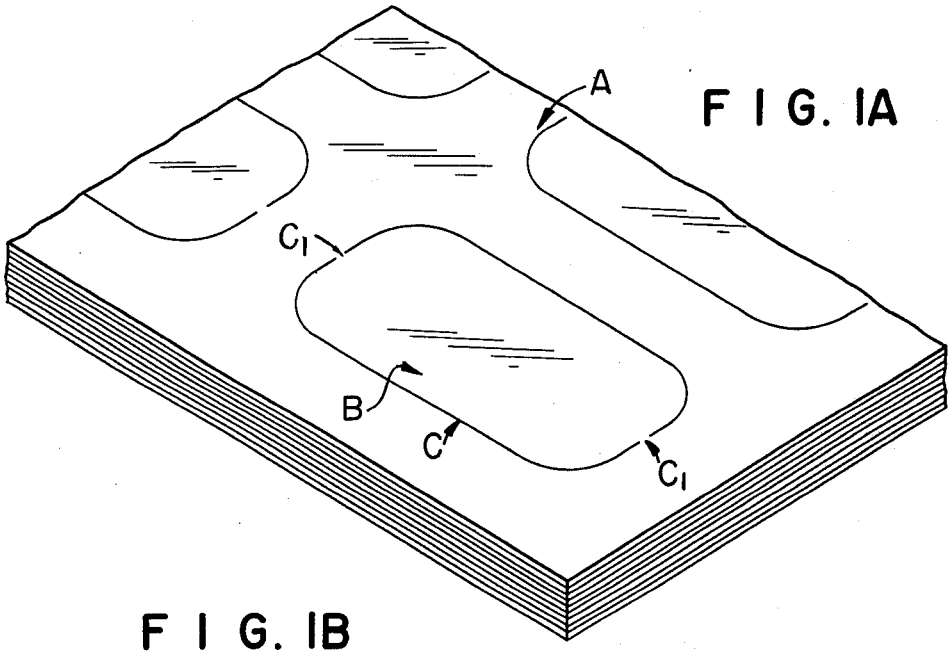
FIG. 1A
FIG. 1B
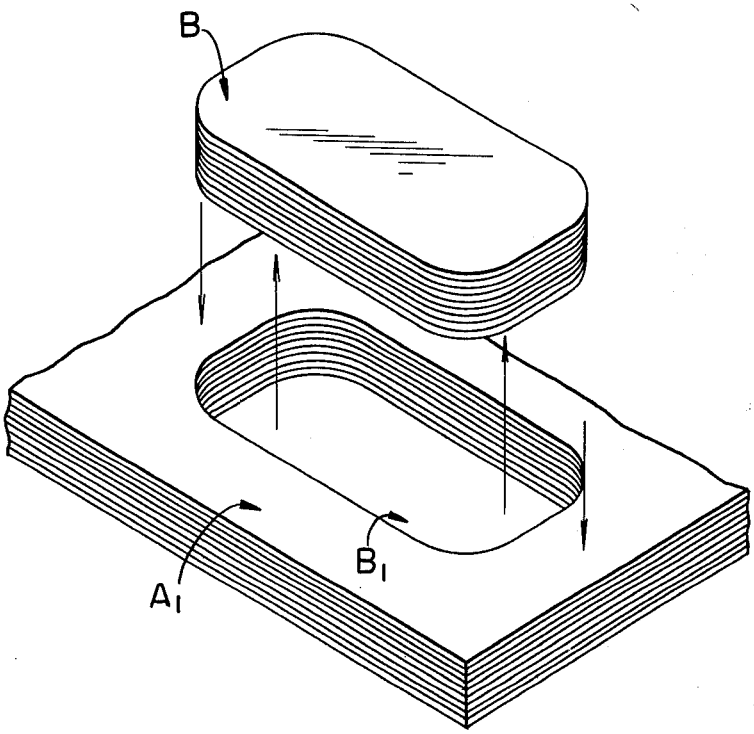

APPARATUS FOR CONTINUOUS PUSHING OUT OF SHEET PRODUCT FROM BLANK

BACKGROUND OF THE INVENTION

This invention relates to apparatus for continuously pushing out a sheet product from a sheet blank in which cut lines defining the sheet products are formed in advance.

Sheet products such as cards, labels, tags, etc. made of paper, cardboard or synthetic resin, and such as profiled two-dimensional sheets of cardboard from which three-dimensional articles such as boxes are fabricated, are produced on a mass-production basis by punching them out from a sheet blank. For this purpose, a cutting die having the same contour as the profile of the sheet products is used for punching out the sheet products in one action. Alternatively, the cutting die is used to form in the sheet blank cut lines corresponding to the contour of the sheet products in advance. In this case, the sheet blank cut beforehand with the cut lines must be subjected to a secondary process in which the part of the blank surrounded by the cut lines is pushed out or separated from the remaining part of the blank. Among these two methods, the latter is more often used in industry.

The secondary process of the latter method may be carried out with the sheet blank precut with cut lines held stationary. But more advantageously, the process is carried out while the sheet blank is moved or conveyed continuously. This enables the process to be incorporated in a continuous production line in which other automatic production processes are carried out.

Conventional apparatus for carrying out the above mentioned secondary process comprises a pair of cylindrical or barrel-shaped drums disposed one above the other and having pushing-out pins or the like implanted on the outer surfaces thereof. A sheet blank to be subjected to the pushing-out process is successively fed into the space between the drums while these drums are being rotated in opposite directions, whereby the part of each sheet blank defined by the cut lines is successively pushed out by the pushing-out pins.

In this apparatus, however, undue forces are imposed on each sheet blank because of difference in peripheral speed between the tip parts and proximal parts of the pushing-out pins and because of continual change of the angular position of the pushing-out pins from the instant immediately prior to the pushing-out operation to the instant immediately after the same. This problem cannot be solved even when the diameter of the drums is increased. Moreover, in this type of the apparatus, sheet products and scrap blanks from which the sheet products are separated tend to be caught by the pins on the drums which are not associated therewith.

SUMMARY OF THE INVENTION

In view of the above problems of the prior art apparatus, it is the main object of this invention to provide a novel and improved apparatus for continuous pushing out of at least one sheet product from a blank comprising at least one sheet formed in advance with cut lines defining the sheet product, wherein the pushing out operation can be carried out without accompaniment of any undue forces exerted on the sheet blank and without the pushed out sheet product and the scrap blank being undesirably caught by pushing-out pins and so on.

Another object of this invention is to provide an apparatus of the above class, wherein the pushed out sheet product and the scrap blank are separately led out of the apparatus after the pushing out operation.

According to this invention, there is provided apparatus for continuous pushing out of at least one sheet product from a blank comprising at least one sheet formed in advance with cut lines corresponding to the contour of the sheet product, the apparatus comprising a pair of endless moving means having respective spans thereof disposed in opposed relationship and driven in the same direction from one end thereof to the other end, said spans being arranged in mutually converging relationship with respect to said direction, means for supplying the balnk between said spans at the one ends thereof so as to be conveyed along the spans, blank holding members secured to one of said endless means in spaced apart relationship with respect to the moving direction thereof and disposed at positions enabling the holding members to abut on that part of the blank outside of said contour of the sheet product at one side of the blank sheet while the blank is being conveyed between said spans, sheet product pushing out members secured to the other endless means in spaced apart relationship with respect to the moving direction thereof and disposed at positions enabling the pushing out members to abut on that part of the blank inside of said contour of the sheet product at the other side of the blank while the blank is being conveyed between said spans, blank back-up means yieldably supported on the other endless means at positions opposing said holding members, respectively, and cooperating with the holding members to grip the blank therebetween while it is being conveyed between said spans, and sheet product backup means yieldably supported on the one endless means at positions opposing at least some of said pushing out members, respectively, and cooperating with the pushing out members to grip the part of the blank inside of said contour while the blank is being conveyed between said spans, the converging relationship between said spans being such that the loci of the blank holding members and the sheet product pushing out members are spaced apart in the region of said one end of the spans and partially overlap each other in the region of said other end, whereby the part of the blank inside of said contour are gradually pushed out from the remaining part of the blank transversely to said direction with resultant yielding of said blank backup means and said sheet product backup means while the blank is conveyed between the spans.

The features which are believed to be novel and characteristic of this invention are set forth with particularity in the appended claims. The invention itself, however, together with the further objects and advantages thereof, will be best understood from the following detailed description of a preferred embodiment of the invention with reference to the accompanying drawings, in which like reference characters denote the same parts and elements.

BRIEF DESCRIPTION OF THE DRAWINGS

In the drawings:

FIG. 1A is a fragmentary perspective view showing a stack of sheets constituting a blank formed preliminarily with cut lines defining sheet products;

FIG. 1B is a perspective view showing the stack of sheets undergoing a sheet product pushing out operation;

DETAILED DESCRIPTION

As conducive to a full understanding of the nature and utility of this invention, the following brief consideration of a sheet product pushing out operation is first presented with reference to FIGS. 1A and 1B.

FIG. 1A shows a blank A comprising a stack of sheets from which sheet products B are pushed out. Each sheet product B is defined by cut lines C formed preliminarily by a cutting die not shown. The formation of the cut lines C is made with some parts $C_1$ left uncut which connect the sheet products B with the remaining part of the blank A. The parts $C_1$ may be intentionally left. But even if the parts $C_1$ are not left intentionally, some connecting parts tend to be left as a result of the slightly imperfect cutting operation, so that the sheet products B are retained in the blank A.

In order to separate the sheet products B from the remaining part of the blank A, they must be forced or pushed in opposite directions as indicated by the arrows shown in FIGS. 1B. As a result of this operation, the blank A is separated into the sheet products B and the scrap part $A_1$ with a hole $B_1$ left therein.

The operation for pushing out the sheet products B from the scrap part $A_1$ as shown in FIG. 1B is carried out effectively by the apparatus according to this invention as illustrated in FIGS. 1 through 5. It will be understood that the blank A is supplied into the apparatus in the form of a stack of sheets but a single sheet could also be subjected to the pushing out operation in the apparatus.

Figure 2:
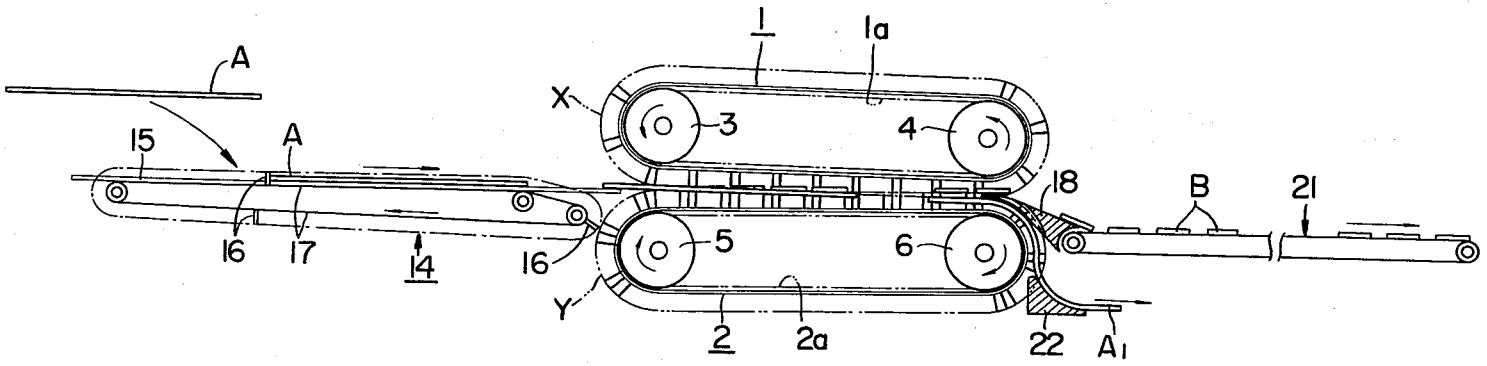
FIG. 2 is a diagrammatic side elevation showing a preferred form of the apparatus according to this invention.

Referring now to FIG. 2, the apparatus according to this invention comprises upper and lower endless moving means 1 and 2, which are combined to form a major part of the continuous sheet product pushing out apparatus.

Figure 5:
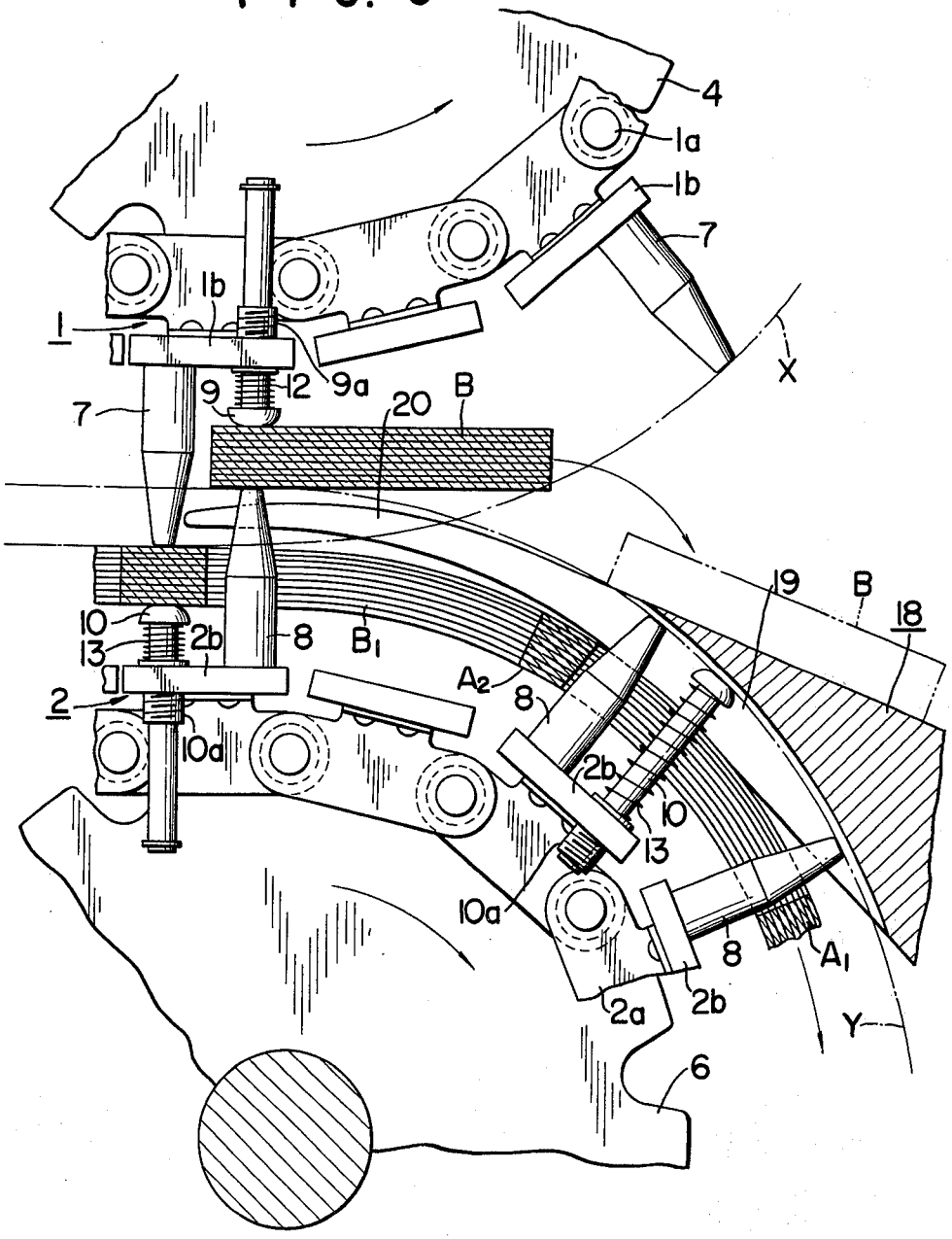
FIG. 5 is a fragmental side elevation, partly in vertical section, on an enlarged scale, showing a part of the apparatus other than the parts shown in FIGS. 3 and 4, wherein the final stage of the operation is carried out.

The lower span of the upper endless moving means 1 and the upper span of the lower endless moving means 2 are extended linearly in a manner slightly converging from the left-hand supply side toward the right-hand delivery side as shown in FIG. 2. The endless means 1 is passed around sprocket wheels 3 and 4, while the endless means 2 is passed around sprocket wheels 5 and 6. The endless means 1 and 2 comprise series of link chains 1*a* and 2*a*, on which narrow cross-plates 1*b* and 2*b* are secured, respectively, as shown in FIG. 5, so as to extend transversely relative to the moving directions of the link chains 1*a* and 2*a*, and in each of the linear spans of the link chains 1*a* and 2*b*, the cross plates 1*b* or 2*b* are arranged so as to form an apparently single plate extending in the direction of the linear span.

A series of blank holding pins 7 are provided at intervals along the endless means 1 so as to project from the outer surface of the endless means at positions adapted to contact the upper surface of the blank A comprising a stack of sheets in a region outside of the contour C of the sheet products B which are to be pushed out in the apparatus.

Likewise, a series of sheet product pushing out pins 8 are provided at intervals along the endless means 2 to project from the outer surface of the endless means at positions adapted to contact the lower surface of the blank A in a region inside of the contour C of the sheet products B. Although one pushing out pin 8 is sufficient for use in pushing out the sheet products B when the size of the latter is comparatively small, two or more pushing out pins 8 are ordinarily provided to push out each stack of sheet products, when they are of comparatively large size, at forward and rearward positions as shown in FIG. 5.

Furthermore, on the outer surface of the endless means 1, sheet product backup pins 9 of a number corresponding to some of the pushing out pins 8 are provided at positions confronting the same. For instance, when two pushing out pins 8 are provided for each stack of the sheet products B as described above, one backup pin 9 is provided only for the rearward pin 8 operable for pushing up the sheet products B at a rearward position. Likewise, on the outer surface of the lower endless means 2, blank backup pins 10 of a number equal to that of the blank holding pins 7 are provided at positions confronting the holding pins 7.

Figure 3:
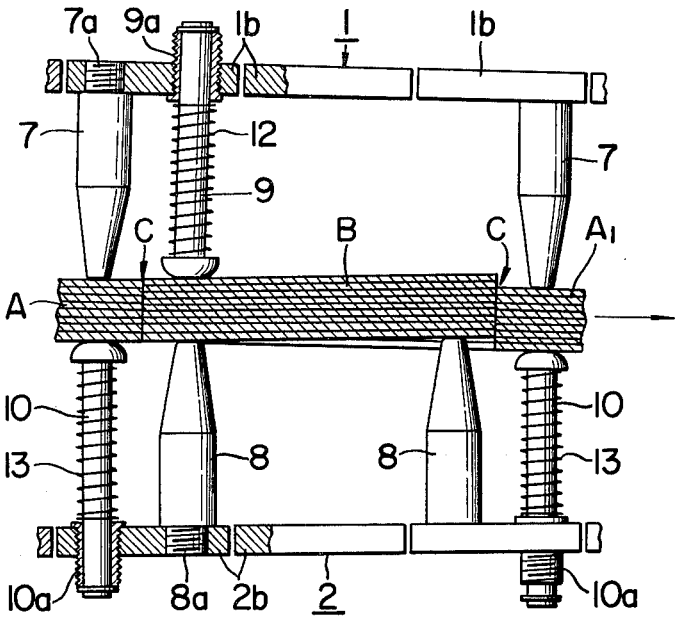
FIG. 3 is a fragmental side elevation, partly in vertical section, on an enlarged scale, showing part of the apparatus shown in FIG. 3 in a certain stage of ssheet product pushing out operation.
Figure 4:
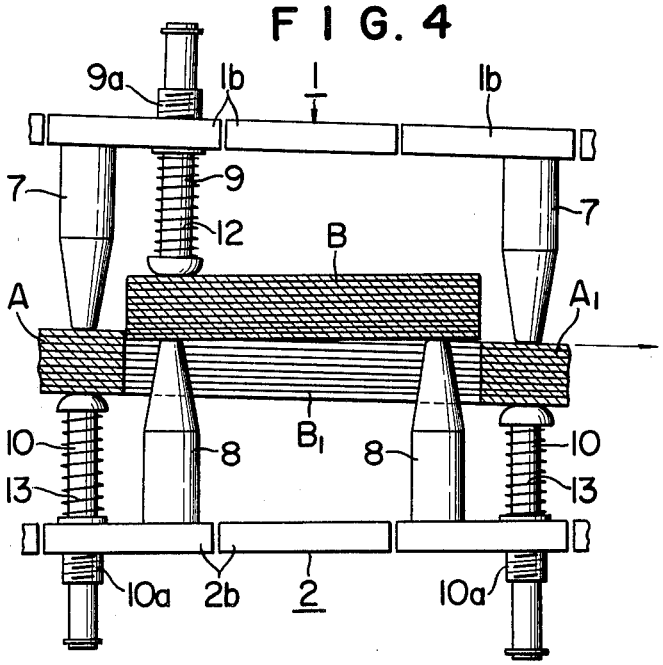
FIG. 4 is a view similar to FIG. 3, but showing other parts of the apparatus in a more advanced stage of the operation.

The holding pins 7 and the pushing out pins 8 are secured in a fixed manner to the cross-plates 1*b* and 2*b*, by inserting threaded ends 7*a* and 8*a* of the pins 7 and 8 into the cross-plates, respectively, as illustrated in FIG. 3, whereby the lengths of the projecting parts of the pins 7 and 8 are made invariable. On the other hand, the backup pins 9 and 10 are mounted freely slidably within sleeves 9*a* and 10*a* which are fixed in the cross-plates 1*b* and 2*b* in a thread-engaging manner. The back-up pins 9 and 10 are further provided with coil springs 12 and 13, respectively, so that the pins 9 and 10 are thereby urged toward positions to provide projecting lengths equal to those of the holding and pushing out pins 7 and 8.

The gap between the lower span of the upper endless means 1 and the upper span of the lower endless means 2 is gradually narrowed toward the delivery side of the spans because of the aforementioned converging arrangement, and at the supply side, the locus X of the tips of the pins 7 and 9 on the upper endless means 1 is somewhat spaced apart from the locus Y of the tips of the pins 8 and 10 on the lower endless means 2, whereas at the delivery side, the two loci X and Y partly overlap each other.

In the arrangement of FIG. 2, there is further provided a mechanism 14 for supplying the sheet blank A, preliminarily formed with cut lines conforming to the contour of the sheet products B, to the supply side of the opposing spans of the upper and lower endless means 1 and 2. The mechanism 14 may comprise a guide plate 15 for receiving and guiding the sheet blank A, and a chain conveyer 17 which has, at a plurality of positions along its length, claws 16 for seizing the sheet blank A.

At the delivery side of the opposing spans of the endless means 1 and 2, there is further provided a separator 18 which separates the pushed out sheet products B from the scrap part $A_1$ of the blank A. As shown in FIG. 5, the separator 18 has a curved body with comb-shaped front edge 20, which is provided with a plurality of slots 19 allowing passage of the pins 7, 8, 9, and 10 therethrough, and is interposed between the expected paths of the pushed out sheet products B and the scrap part $A_1$ of the sheet blank A.

In the arrangement of FIG. 2, reference numeral 21 designates a sheet product conveyer disposed downstream of the separator 18, and reference numeral 22 designates a scraper which is provided as required at the delivery side of the lower endless means 2.

In operation, the upper and lower endless means 1 and 2 are so driven that the opposing linear spans thereof are moved in a direction from the supply side to the delivery side at a constant speed. The sheet blank supplying mechanism 14 and the sheet product delivering conveyer 21 are also driven is synchronism with the endless means 1 and 2.

When the blank A, which may be a single sheet or a stack of sheets formed with cut lines conforming to the contour of the products B, is placed on the guide plate 15 of the blank supplying mechanisms 14, it is caught by the claws 16 projecting from the chain conveyer 17, and pushed forward in the arrow-marked direction toward the supply side of the opposing spans of the endless means 1 and 2.

The blank A thus introduced between the loci X and Y of the tips of the pins projecting from the endless means 1 and 2 is then caught between the tips of the pins 7 and 10 projecting from the upper and lower endless means 1 and 2, respectively, and conveyed toward the delivery side while the endless means 1 and 2 are driven as described above. At this time, the holding pins 7 are brought into contact with the upper surface of the scrap part $A_1$ of the blank A, and the pushing out pins 8 are brought into contact with the lower surface of the sheet products B.

As previously described, the endless means 1 and 2 are so arranged that the two opposing linear spans thereof converge toward the delivery side, and the loci X and Y of the tips of the pins, spaced apart at the supply side, are overlapped with each other at the delivery side of the same. As a result, the blank A being fed between the endless means 1 and 2 is subjected to gradually increasing pressing forces of the holding pins 7 and the pushing out pins 8 as it advances, and the sheet products B are pushed upward with respect to the scrap part $A_1$ of the blank A.

More specifically, when the blank A is conveyed between the upper and lower endless means 1 and 2, the leading part of the blank A, which constitutes a part of the scrap part $A_1$, is seized between the holding pin 7 and the backup pin 10 confronting the holding pin 7. Upon further advance of the blank, the trailing edge of the scrap part $A_1$ of the blank A is seized between another pair of the holding pin 7 and the backup pin 10, as indicated in FIG. 3, and at this instant the forward portion of the product part B of the blank A is somewhat pushed upward, by the pushing out pin 8, relative to the leading edge of the blank held between the pins 7 and 10. As a result, the forward portion of the product part B of the blank A is sheared from the scrap part $A_1$ of the same blank A along a forward portion of the cut lines C formed between the two parts $A_1$ and B, and is raised upward as indicated at the right-hand part of FIG. 3. The severing and the displacement of the product part B also occurs along the trailing portion of the cut lines C when the blank A is further advanced between the endless means 1 and 2, and the product part B thus completely severed from the scrap port $A_1$ is pushed upward by the pushing out pins 8 as clearly indicated in FIG. 4 leaving a punched-out hole $B_1$ in the scrap part $A_1$. In this state, the backup pins 9 and 10 supporting the sheet blank A from the other side at positions confronting the pushing out pins 8 and the holding pins 7, respectively, are retracted against the forces of the springs 12 and 13 thereby seizing the corresponding parts of the blank even more firmly in cooperation with the pushing out pins 8 and the holding pins 7 as the blank is fed toward the delivery side.

When the blank A comes to the delivery side of the endless means 1 and 2, the rearward portion of the scrap part $A_1$ of the blank A is held firmly between the holding pins 7 and the backup pins 10 confronting the same, while the product part B thus pushed out is held between at least one pushing out pin 8 and a backup pin 9 confronting the same as clearly illustrated in FIG. 5. In this state, the separation of the product part B from the scrap part $A_1$ along the cut lines $C_1$ has been fully accomplished, and the product part B thus obtained and the scrap $A_1$ remaining are held separately between their associated pins.

On the delivery side of the endless means 1 and 2, the product B and the scrap $A_1$ are then guided above and below the comb-shaped front edge 20 of the separator 18, respectively. The pushing out pins 8, which have been holding the product B, now move down through the slots 19 of the separator 18 as the lower endless means 2 rotates downwardly around the sprocket wheel 6, and the baackup pins 9, which have been depressing the product part B on the upper surface thereof, are now permitted to extend downwardly by the springs 12 because of the retraction of the pushing out pins 8, and now escape upward as the upper endless means 1 rotates upwardly around the sprocket wheel 4.

Thus the product part B is released from the pins 8 and 9 and delivered on the upper surface of the separator 18. The product part B thus delivered on the separator slides away toward the conveyer 21 by its own weight, and is conveyed on the conveyer to the right as viewed in FIG. 2.

On the other hand, the scrap part $A_1$ guided below the comb-shaped forward edge 20 of the separator 18 is forcibly separated from the lower endless means 2 by means of the scraper 22. In most cases, however, the scrap part $A_1$ is easily separated from the lower endless means 2 because the pushing out pins 8 of the endless means 2 can be moved out of the hole $B_1$, tearing the forward part of the scrap part $A_1$ because of their rapid angular displacement which occurs as the pins 8 move down around the sprocket wheel 6. For this reason, the scraper 22 may be dispensed with without hampering the operation of the apparatus.

As will be apparent from the above description, the apparatus according to this invention can easily push out the part of the blank forming the sheet products from the remaining part of the same transversely to the feeding direction thereof without any trouble and in a reliable manner, and by combining the apparatus with other apparatus for preparing the blanks and for handling the sheet products, a continuous production line for blanking sheet products can be easily established.

I claim:

1. Apparatus for continuous pushing out of at least one sheet product from a blank comprising at least one sheet formed in advance with cut lines corresponding to the contour of the sheet product, said apparatus comprising:

a pair of endless moving means (1, 2) having respective spans thereof disposed in opposed relationship and driven in the same direction from one end thereof to the other end, said spans being arranged in mutually converging relationship with respect to said direction;

means (14) for supplying the blank (A) between said spans at the one ends thereof so as to be conveyed along the spans;

blank holding members (7) secured to one of said endless means (1) in spaced apart relationship with respect to the moving direction thereof and disposed at positions enabling the holding members (7) to abut on that part of the blank (A) outside of said contour (C) of the sheet product at one side of the blank while the blank is being conveyed between said spans;

sheet product pushing out members (8) secured to the other endless means (2) in spaced apart relationship with respect to the moving direction thereof and disposed at positions enabling the pushing out members (8) to abut on that part of the blank inside of said contour (C) of the sheet product (B) at the other side of the blank (A) while the blank is being conveyed between said spans;

blank backup means (10, 13) yieldably supported on the other endless means (2) at positions opposing said holding members (7), respectively, and cooperating with the holding members to grip the blank (A) therebetween while it is being conveyed between said spans; and sheet product backup means (9, 12) yieldably supported on the one endless means (1) at positions opposing at least some of said pushing out members (8), respectively, and cooperating with the pushing out members to grip the part of the blank inside of said contour (C) while the blank is being conveyed between said spans, the converging relationship between said spans being such that the loci (X, Y) of the blank holding members (7) and the sheet product pushing out members (8) are spaced apart in the region of said one end of the spans and partially overlap each other in the region of said other end, whereby the part (B) of the blank inside of said contour (C) is gradually pushed out from the remaining part ($A_1$) of the blank transversely to said direction with resultant yielding of said blank backup means (10, 13) and said sheet product backup means (9, 12) while the blank is conveyed between the spans.

2. The apparatus as claimed in claim 1, wherein said endless means (1, 2) are endless chains of links (1*a*, 2*a*) with each link rigidly carrying a cross-plate (1*b*) thereon, the cross-plate of the one endless means (1) supporting thereon said blank holding members (7) and said sheet product backup means (9, 12), the cross-plates of the other endless means (2) supporting thereon said sheet product pushing out members (8) and said blank backup means (10, 13).

3. The apparatus as claimed in claim 1, wherein said blank holding members are projecting pins (7) implanted in said one endless means (1).

4. The apparatus as claimed in claim 1, wherein saiid sheet product pushing out members are projecting pins (8) implanted in said other endless means (2).

5. The apparatus as claimed in claim 1, wherein said blank backup means are pins (10) slidably supported by said other endless means (2) and resiliently urged in the direction away from the other endless means (2).

6. The apparatus as claimed in claim 1, wherein said sheet product backup means are pins (9) slidably supported by said one endless means (1) and resiliently urged in the direction away from the one endless means (1).

7. The apparatus as claimed in claim 6, further including separator means (18) disposed between said other ends of said spans for guiding the sheet product (B) pushed out of the blank (A) and the remaining part ($A_1$) of the blank in different directions.

8. The apparatus as claimed in claim 7, wherein said separator means (18) is a curved member extending along said other end of the span of the other endless means (2) and formed with slot means (19, 20) for allowing said blank holding members (7) and said sheet product pushing out means (8) to move through the separator means.

9. The apparatus as claimed in claim 7, further including sheet product conveying means (21) disposed downstream of said separator means (18) for conveying the sheet product (B) away from the separator means.

10. The apparatus as claimed in claim 7, further including means (22) provided at the other end of the span of the other endless means (2) to separate the remaining part ($A_1$) of the blank from the other endless means (2).

* * * * *